United States Patent [19]

Owens et al.

[11] 4,251,012

[45] Feb. 17, 1981

[54] PASSIVE LIQUID DOSING DISPENSER

[75] Inventors: William A. Owens, Cincinnati, Ohio; Alvester Williams, Jr., Jackson, Miss.

[73] Assignee: The Procter & Gamble Company, Cincinnati, Ohio

[21] Appl. No.: 58,974

[22] Filed: Jul. 20, 1979

[51] Int. Cl.[3] ..... E03D 9/02

[52] U.S. Cl. ..... 222/185; 4/227; 222/442

[58] Field of Search ..... 222/181, 185, 424.5, 222/442; 141/230, 323; 4/222, 224, 227, 228

[56] References Cited

U.S. PATENT DOCUMENTS

| | | | |
|---|---|---|---|
| 650,161 | 5/1900 | Williams et al. . | |
| 1,144,525 | 6/1915 | Blake . | |
| 1,175,032 | 3/1916 | Williams . | |
| 2,688,754 | 9/1954 | Willits et al. | 4/228 |
| 2,812,119 | 11/1957 | Bethune . | |
| 2,839,763 | 6/1958 | Newsom | 4/227 |
| 3,073,488 | 1/1963 | Komter . | |
| 3,407,412 | 10/1968 | Spear | 4/228 |
| 3,444,566 | 5/1969 | Spear | 4/228 |
| 3,769,640 | 11/1973 | Castronovo | 4/228 |
| 3,772,715 | 11/1973 | Nigro | 4/228 |
| 3,781,926 | 1/1974 | Levey | 4/228 |
| 3,864,763 | 2/1975 | Spransy | 4/227 |
| 3,943,582 | 3/1976 | Daenincky et al. | 4/227 |
| 3,952,339 | 4/1976 | Baur et al. | 4/228 |
| 3,965,497 | 6/1976 | Corsette | 4/227 |
| 4,064,572 | 12/1977 | Wicks et al. | 4/227 |
| 4,171,546 | 10/1979 | Dirksing | 4/227 |
| 4,186,856 | 2/1980 | Dirksing | 4/228 X |
| 4,208,747 | 6/1980 | Dirksing | 4/228 |

*Primary Examiner*—Robert J. Spar
*Assistant Examiner*—Fred A. Silverberg
*Attorney, Agent, or Firm*—E. Kelly Linman; John V. Gorman; Richard C. Witte

[57] ABSTRACT

A passive dosing dispenser for issuing, for example, a predetermined volume of a liquid toilet tank additive solution into a toilet tank as the water is draining therefrom while the toilet is flushing. The dispenser employs no moving parts, and acts in response to the lowering of the water level in the toilet tank to dispense the liquid solution at a point in the flush cycle when it can be most effectively utilized. The liquid solution in the dispenser is maintained in an isolated condition by means of air-locks from the toilet tank water surrounding the dispenser regardless of the depth to which the dispenser is immersed in the tank during quiescent periods intermediate flush cycles.

7 Claims, 8 Drawing Figures

PASSIVE LIQUID DOSING DISPENSER

TECHNICAL FIELD

The present invention pertains, in general, to providing a dosing type dispenser for such products as liquid toilet tank additives: for instance, cleansers and/or disinfectants. More specifically, the present invention provides an entirely passive (no moving parts) dispenser from which a liquid type product will be incrementally issued: a dose-volume of liquid solution being issued each time the water in the toilet tank recedes from around the dispenser. Dispenser embodiments of the present invention also provide air-lock isolation of the liquid product solution within the dispenser from the toilet tank water surrounding the dispenser during quiescent periods intermediate flush cycles. Plural product dispenser embodiments are also provided which can, because each provides product solution isolation during quiescent periods, co-dispense solutions of two or more products which should not be mixed before their intended use. Dispenser embodiments of the present invention may be provided with an integral solution reservoir or the solution reservoir may take the form of a discrete container of liquid product solution temporarily attachable to the dispenser, the dispenser being continually reused merely by replacing the exhausted product container.

BACKGROUND ART

Passive dosing dispensers of various geometries are disclosed in prior art patents. For instance, U.S. Pat. No. 650,161 which issued to J. Williams et al. on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to Nigro on Nov. 20, 1973, and U.S. Pat. No. 3,781,926 which issued to Levey on Jan. 1, 1974, and U.S. Pat. No. 3,943,582 which issued to Daeninckx et al. on Mar. 16, 1976 disclose passive dispensers which are alternately flooded and then gravitationally drained. Moreover, U.S. Pat. No. 3,407,412 which issued to Spear on Oct. 29, 1968, and U.S. Pat. No. 3,444,566 which issued to Spear on May 20, 1969 disclose dispensers which, although they have no moving parts, must be connected to a pressurized water supply such as the trap refill tube in a toilet tank and in which the direction of flow alternates in labyrinth passages.

U.S. Pat. No. 1,144,525 issued to Blake on June 29, 1915 discloses a passive liquid dispensing apparatus employing an inverted J-shaped syphon tube to dispense a dilute liquid product solution as the water level in the tank is lowered. However, the dilute liquid product solution contained within the dispensing chamber is not isolated from the remainder of the toilet tank water during quiescent periods intermediate flush cycles. U.S. Pat. No. 2,839,763 issued to Newsom on June 24, 1958 discloses a bottle containing a liquid disinfectant and equipped with a screw cap which also functions as the product dispensing apparatus. As the toilet tank water rises, it traps a pocket of air in chamber 36 which is connected by virtue of passageway 40 to the liquid disinfectant which is substantially even with the lowermost end of the container neck. As the water level in the tank continues to rise, air is pumped into the container to vitiate the partial vacuum existing therewithin. In addition, the pumping action causes a portion of the liquid disinfectant contained in the cap to be pumped through passageway 44 and out discharge port 30 in response to the rising water level. However, the liquid disinfectant is injected into the toilet tank as the water level rises, i.e., at a point in the flush cycle when it is least likely to be effective in cleansing and/or disinfecting the toilet bowl. U.S. Pat. No. 2,812,119 issued to Bethune on Nov. 5, 1957 discloses a liquid dispenser which incorporates a pumping cycle to fill a reservoir as the water level rises. However, the reservoir is thereafter allowed to drain by gravity at a controlled rate into the liquid contained in the toilet tank. Accordingly, the dispensed material is added during quiescent periods intermediate flush cycles when it is least likely to be effective in cleansing and/or disinfecting the toilet bowl.

U.S. Pat. No. 2,688,754 issued to Willits et al. on Sept. 14, 1954, U.S. Pat. No. 3,073,488 issued to Komter on Jan. 15, 1963, U.S. Pat. No. 3,864,763 issued to Spransy on Jan. 11, 1975 and U.S. Pat. No. 3,965,497 issued to Corsette on June 29, 1976 disclose various forms of prior art liquid dispensers which are passive and which dispense liquid material in response to lowering of the water level in the toilet tank.

However, none of the above noted prior art references disclose means for discharging a predetermined dose-volume of liquid product solution in response to a decreasing water level in combination with the other desirable dispenser characteristics provided by the present invention, i.e., passivity, constant volume discharge regardless of depth of immersion, and product solution isolation from the toilet tank water during quiescent periods intermediate flush cycles.

DISCLOSURE OF INVENTION

In accordance with one aspect of the present invention, a passive dose-volume liquid solution dispenser which isolates said liquid solution by means of air-locks from a body of liquid in which said dispenser is immersed is provided. Said dispenser preferably comprises: a non-vented reservoir for containing a quantity of the liquid product solution to be dispensed, said reservoir having an outlet adjacent its lowermost surface in fluid communication with a liquid solution collector located at a lower elevation than said outlet of said reservoir; a measuring pocket of predetermined volume, said measuring pocket having an inlet in fluid communication with said liquid collector, said inlet being at a higher elevation than said collector; means for filling said measuring pocket with said liquid solution from said collector in response to the level of a body of liquid in which said dispenser is immersed being raised from a first elevation to a second elevation; means for introducing a volume of air substantially equal to the dose-volume of liquid solution to be dispensed into the uppermost reaches of said non-vented reservoir in response to the level of said body of liquid being raised from said first elevation to said second elevation; and means for discharging said liquid solution contained within said measuring pocket from said dispenser in response to the level of said body of liquid being lowered to said first elevation from said second elevation. In a particularly preferred embodiment, the means for filling said measuring pocket with liquid solution and the means for introducing a volume of air substantially equal to that of said measuring pocket into the upper reaches of said non-vented solution reservoir comprise an air pump, an expansion chamber and an air vent in the dispenser, said air pump having an open lowermost end to permit fluid communication with the body of liquid in which said dispenser is immersed and an uppermost end in fluid communication with said liquid solution collector, said collector also being in fluid communication with the lowermost end of the expansion chamber, said expansion chamber having its uppermost end in fluid communication with said inlet to said measuring pocket as well as with said air vent, said air vent being so vertically positioned on said dispenser as to permit said air pump to force liquid solution from said collector into said expansion chamber to a height sufficient to fill said measuring pocket through said inlet in response to the level of said body of liquid being raised from said first elevation to said second elevation. In a particularly preferred embodiment, the means for discharging the liquid solution contained within the measuring pocket in response to a falling liquid level within the toilet tank comprises an inverted J-shaped syphon tube having its uppermost end in fluid communication with the lowermost reaches of said measuring pocket and an open lowermost end to permit fluid communication with the body of liquid in which said dispenser is immersed. The syphon tube preferably exhibits an increasing cross-sectional area along its length in the direction of its lowermost end to facilitate rapid discharge of the liquid solution into the tank.

BRIEF DESCRIPTION OF THE DRAWINGS

While the specification concludes with claims particularly pointing out and distinctly claiming the present invention, it is believed that the present invention will be better understood from the following description in conjunction with the accompanying drawings in which:

DETAILED DESCRIPTION OF THE INVENTION

Figure 1:
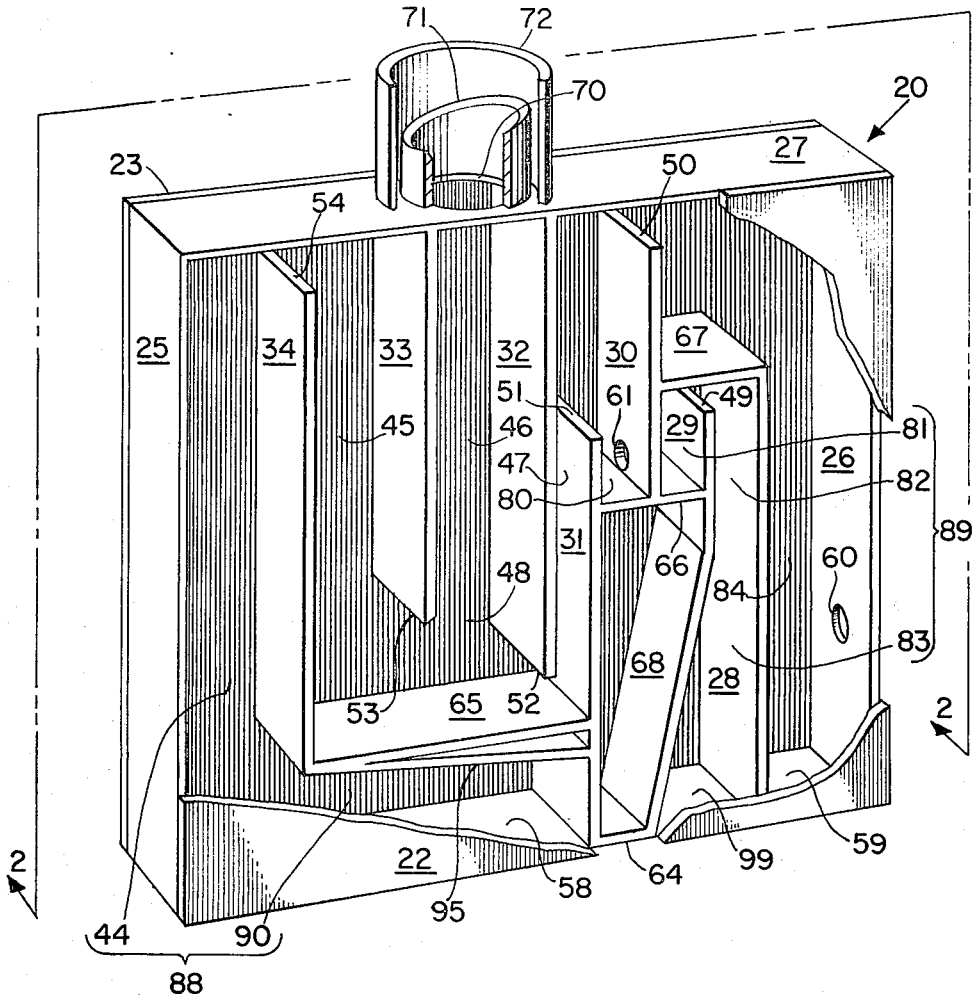
FIG. 1 is a partially torn away perspective view of a passive liquid dosing dispenser which is an embodiment of the present invention, said dispenser being shown prior to attachment of a non-vented liquid solution reservoir thereto.

Referring now to the Figures in which identical features are identically designated, FIG. 1 shows a dispenser 20 embodying the present invention. Dispenser 20 is utilized in conjunction with a disposable non-vented liquid solution reservoir (not shown in FIG. 1) which may be discarded when its contents have been fully discharged. Dispenser 20 comprises a front wall 22, a back wall 23, two sidewalls 25 and 26, a top wall 27, a bottom wall segment 64, interior vertical partition segments 28, 29, 30, 31, 32, 33, and 34, inclined interior partition segments 68 and 95, and horizontal interior partition segments 65, 66, and 67. Secured to top wall 27 are tubular bayonet member 71 and tubular shroud 72 which serve to connect a disposable non-vented liquid solution reservoir (not shown in FIG. 1) with the interior portions of dispenser 20 through orifice 70 in top wall 27.

Uppermost edges of vertical partition segments 29, 30, 31 and 34 are designated 49, 50, 51 and 54, respectively. Lowermost edges of vertical partition segments 32 and 33 are designated 52 and 53, respectively. An air vent in the form of an orifice 60 is provided in sidewall 26 of the dispenser and an orifice 61 is provided in vertical partition segment 30 just above horizontal partition segment 66.

The dispenser 20 is so configured that an air pump 88 comprising portion 90 defined by the front and back walls of the dispenser, inclined partition segment 95 and the lowermost edge of vertical partition segment 31 and portion 44 defined by the front and back walls of the dispenser, sidewall 25 and vertical partition segment 34 is provided. The lowermost end of the air pump 88 is maintained in fluid communication with the body of liquid in which the dispenser is immersed by means of inlet port 58 defined by the front and back wall portions of the dispenser, sidewall portion 25 and the lowermost portion of vertical partition segment 31. The uppermost portion of the air pump 88 is maintained in fluid communication with the liquid solution collector 48 located intermediate vertical partition segments 31 and 34 by means of vertical passageway 45 intermediate partition segments 33 and 34. Liquid solution to be dispensed is introduced into the liquid solution collector 48 via orifice 70 in top wall 27 from a product solution reservoir (not shown in FIG. 1) via passageway 46 located intermediate partition segments 32 and 33. The righthand portion of the liquid collector 48, as shown in FIG. 1, is maintained in fluid communication with a measuring pocket 80 defined by vertical partition segments 30 and 31 and horizontal partition segment 66 by means of an expansion chamber 47 located intermediate vertical partition segments 31 and 32. The lowermost portion of measuring pocket 80 is maintained in fluid communication with an inverted J-shaped syphon tube 89 comprising portions 81, 82 and 83 by means of an orifice 61 located adjacent horizontal wall segment 66 in vertical partition segment 30. Portion 81 is defined by the front and back walls of the dispenser in conjunction with vertical partition segments 29 and 30, while area 82 is defined by the front and back wall portions of the dispenser in conjunction with horizontal partition segment 67 and vertical partition segments 28 and 29. Finally, portion 83 is defined by means of the front and back wall portions of the dispenser in conjunction with vertical partition segment 28 and inclined partition segment 68. Taken together, areas 81, 82 and 83 form an inverted, J-shaped syphon tube 89 which is maintained in fluid communication with the body of liquid in which the dispenser 20 is immersed by means of inlet/discharge port 99 located at the lowermost end of syphon tube portion 83. Intermediate vertical partition segment 28 and sidewall 26 of the dispenser there is provided a vent chamber 84, the uppermost portion of which is maintained in fluid communication with the uppermost portions of expansion chamber 47 and measuring pocket 80. The lowermost end of vent chamber 84 is maintained in fluid communication with the body of liquid in which said dispenser is immersed by means of inlet port 59.

Figure 2:
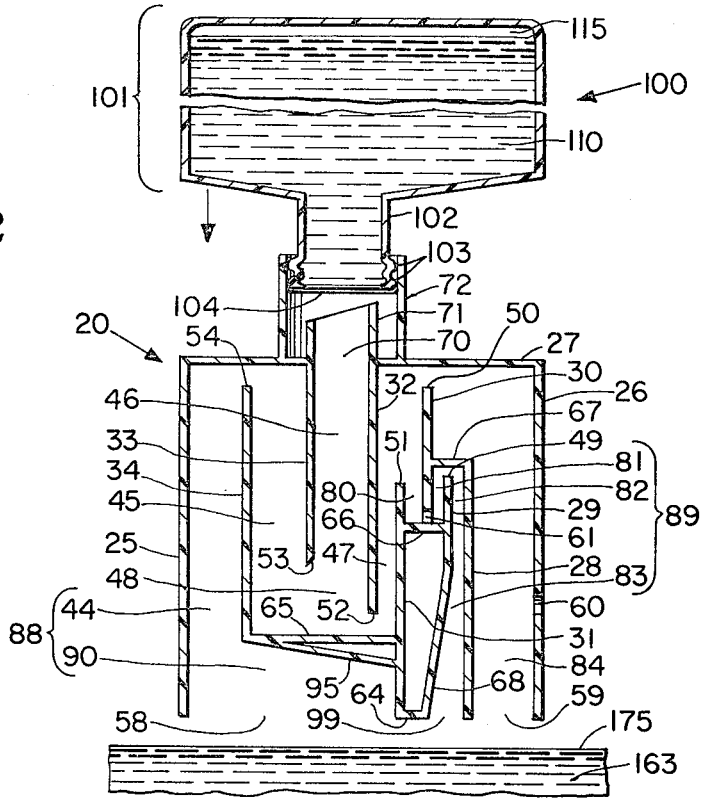
FIG. 2 is a simplified sectional view substantially coinciding with section line 2—2 in FIG. 1 showing addition of a solution reservoir to the dispenser shown in FIG. 1, said dispenser being shown prior to immersion into the toilet tank water.

Briefly, referring to FIG. 2, when a dispenser 20 is to be placed in service in a toilet tank (not shown) on a bracket or other mounting means (not shown) a non-vented product solution reservoir 100 containing the liquid product solution 110 to be dispensed is inserted over the bayonet member 71 of the dispenser 20. The solution reservoir 100 may be of any suitable material including, for example, blow molded polyethylene. It is preferably provided with a body portion 101 and a neck portion 102 designed to provide a leak-proof joint with the dispenser 20. One means of accomplishing the foregoing objective is to provide a plurality of flexible raised ridges 103 molded into the neck portion 102 of the container such that there is a slight degree of interference between the exterior surface of the raised ridges 103 and the interior surface of tubular sheath member 102 on the dispenser 20. Alternatively, the interior of the sheath member 72 could be provided with screw threads and the raised sections on the solution reservoir 100 could comprise mating threads such that the two units could be screwed together. As should be apparent from the foregoing, any of numerous leakproof joinder means well known in the art may be utilized to achieve the desired objective.

In a particularly preferred embodiment of the present invention, a liquid-impermeable membrane 104 is sealed about the periphery of the reservoir neck 102 so as to provide a fluid tight barrier prior to rupture of the membrane by the bayonet member 71 on the dispenser 20. The membrane may be comprised of aluminum foil, plastic film, or any of numerous known materials. The membrane 104 is preferably secured about the periphery of the neck 102 by heat sealing, adhesives, or the like.

Figure 3:
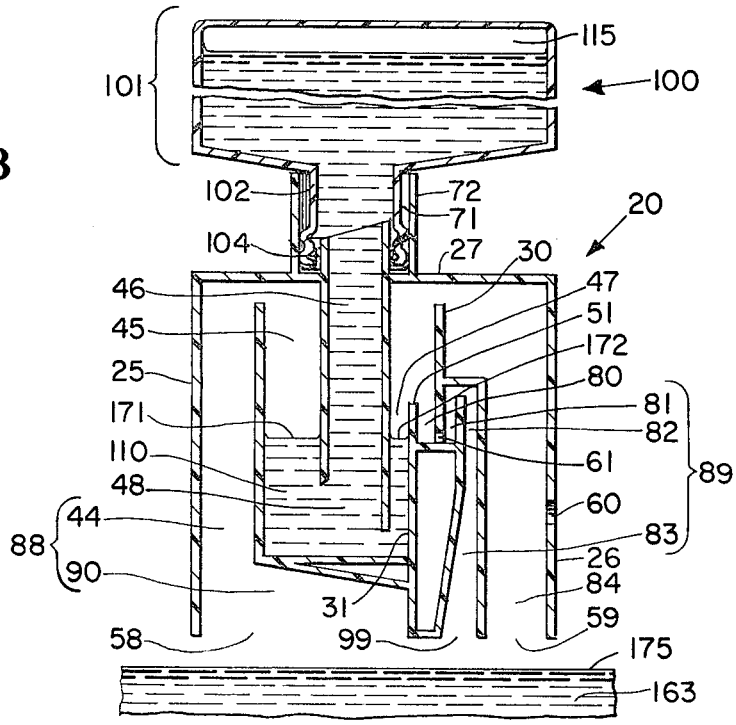
FIGS. 3–7 are simplified sequential sectional views of the dispenser of FIG. 2 during a flush cycle of the toilet.

In the condition illustrated in FIG. 2, just prior to rupture of membrane 104, there is a small head space 115 at the uppermost end of the reservoir 100. This head space is substantially filled by the air originally trapped in the neck portion 102 of the reservoir at the time the liquid-impermeable membrane 104 was secured about its periphery. Once the membrane 104 is ruptured, as generally shown in FIG. 3, the liquid solution 110 is allowed to enter the dispenser liquid collector 48 via orifice 70 and passageway 46 until such time as sufficient vacuum is created in head space 115 to prevent additional liquid from leaving the reservoir 100. Thus, when the dispenser 20 is in a vented condition, i.e., not immersed in liquid, the level 171 of liquid solution in passageway 45 is precisely equal to the level 172 of liquid solution 110 in expansion chamber 47.

Figure 4:
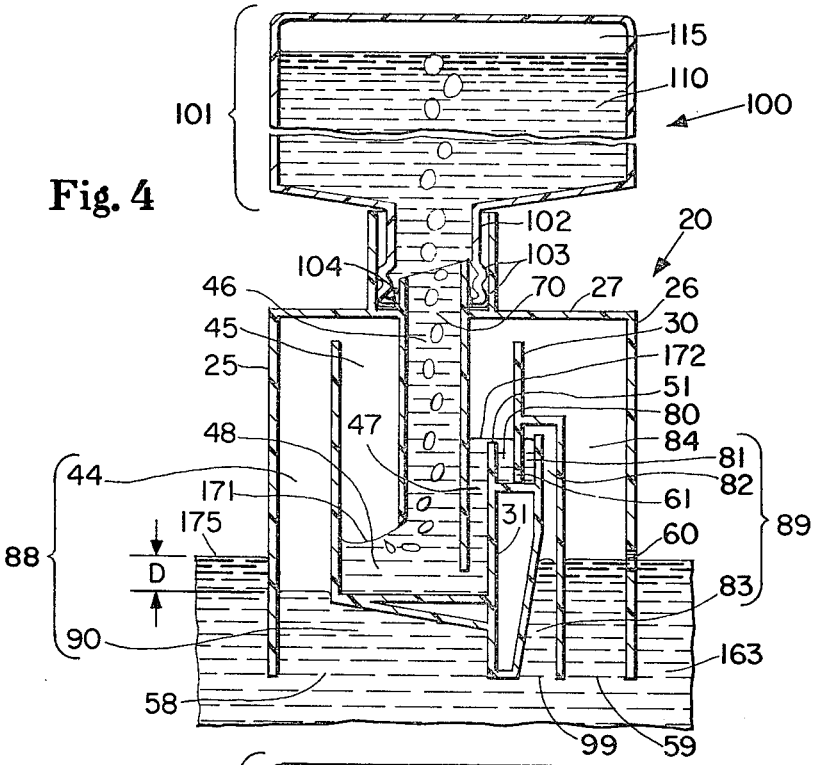

FIGS. 2 and 3 represent the condition existing as the level 175 of a body of liquid 163 is rising within a toilet tank (not shown). FIG. 4 depicts the condition of the dispenser 20 and the non-vented reservoir 100 when the level 175 of liquid 163 has covered the bottom portions of the dispenser, i.e., inlet port 58 of air pump 88, inlet port 59 of vent chamber 84 and inlet/discharge port 99 of the inverted J-shaped syphon tube 89 comprising portions 81, 82 and 83. Once the liquid has covered the lowermost surface of the dispenser 20, it enters air pump 88 through inlet port 58. Due to the internal configuration of the dispenser 20, an air-lock is formed in the uppermost reaches of air pump 88 and the uppermost reaches of passageway 45. The trapped air in the uppermost reaches of air pump 88 and passageway 45 tends to resist the further entrance of toilet tank water 163 due to the presence of the liquid solution 110 within the liquid solution collector 48.

In the condition illustrated in FIG. 4, the uppermost reaches of vent chamber 84 and the uppermost reaches of expansion chamber 47 and measuring pocket 80 are vented to atmosphere by virtue of air vent 60 in dispenser sidewall 26. Since the inverted J-shaped syphon tube 89 comprising portions 81, 82 and 83 is in fluid communication with the measuring pocket 80 by means of orifice 61 in vertical partition segment 30, toilet tank water 163 continues to rise within the syphon tube and vent chamber 88 at substantially the same rate as the surrounding toilet tank water. Since the aforementioned interconnected portions of the dispenser illustrated in FIG. 4 are vented to atmosphere prior to blockage of air vent 60 by the toilet tank water 163, the rising water level in the toilet tank tends to pump air captured within the uppermost reaches of air pump 88 and passageway 45 down against the liquid solution 110 located at level 171 within the liquid solution collector 48. The driving head of the air pump 88 is equal to the difference in elevation between the toilet tank water level 175 and the level of water within the air pump, as indicated by the letter "D" in FIG. 4. The effect of the air pump is to lower the level of liquid solution 110 within passageway 45 to approximately the lowermost edge 53 of partition segment 33, as generally shown in FIG. 4. Because the liquid solution 110 contained within expansion chamber 47 and measuring pocket 80 is vented to atmosphere in the condition shown in FIG. 4, the force exerted by the compressed air raises the liquid solution 110 to a level 172 above edge 51 of vertical partition segment 31 in expansion chamber 47. Thus, the inlet to measuring pocket 80 is defined by edge 51 of vertical partition segment 31. Liquid solution 110 is allowed to enter the measuring pocket 80 and that portion 81 of the J-shaped syphon tube 89 in fluid communication therewith by virtue of orifice 61 as it flows across edge 51 of vertical partition segment 31. As will also be apparent from FIG. 4, the pumping cycle causes air bubbles to enter the headspace 115 of the liquid solution reservoir 100 to compensate for the liquid solution evacuated from the reservoir during the preceding discharge cycle. This pumping action prevents an excessive vacuum buildup in the headspace 115 of the reservoir 100, a feature necessary to ensure complete utilization of all the liquid solution 110 contained within the reservoir.

Figure 5:
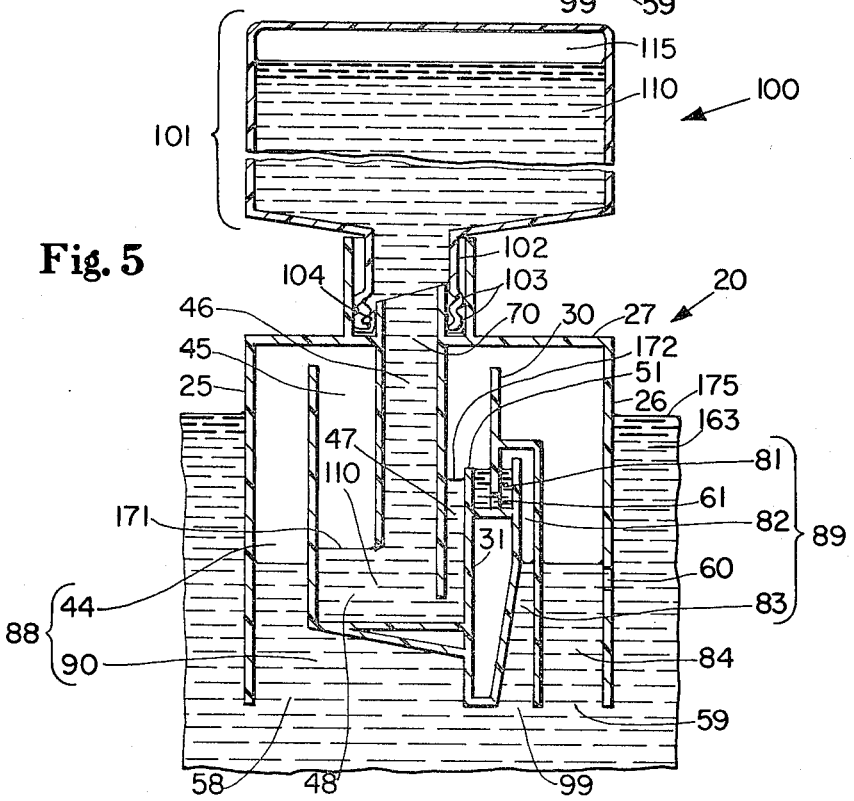

Looking next at FIG. 5, it will be observed that the level 175 of toilet tank water 163 has now risen sufficiently high to block air vent 60 in dispenser sidewall 26. Blockage of air vent 60 creates a secondary air-lock in the uppermost reaches of vent chamber 84 and the uppermost reaches of expansion chamber 47 and measuring pocket 80. The air-lock thus formed also prevents any further rise of the toilet tank water within the inverted J-shaped syphon tube 89 generally illustrated in FIG. 5.

As should also be noted from FIG. 5, which represents the steady state or equilibrium condition existing intermediate flush cycles of the toilet, creation of the secondary air-lock in the uppermost regions of vent chamber 84 and the uppermost regions of expansion chamber 47 and measuring pocket 80 tends to cause the level 172 of liquid product solution 110 within the expansion chamber 47 to drop slightly below uppermost edge 51 of partition segment 31, thus leaving measuring pocket 80 and the lowermost end of syphon tube portion 81 filled to a level substantially equal to that of uppermost edge 51 of partition segment 31. In this connection, it should also be noted that the level 171 of liquid solution 110 in the lowermost reaches of passageway 45 is slightly higher than during the transient period illustrated in FIG. 4, since the pumping operation has ceased.

As will be apparent from an inspection of FIG. 5, the liquid solution 110 contained both within the reservoir 100 and the dispenser 20 are totally isolated by means of air-locks from the toilet tank water 163 in which the dispenser is immersed. The liquid solution 110 in collector section 48 is isolated from the water 163 in the lowermost reaches of air pump 88 by means of an air-lock within the uppermost reaches of the air pump and passageway 45; the liquid solution in expansion chamber 47 and measuring pocket 80 is isolated from the toilet tank water in the lowermost reaches of vent chamber 84 by means of an air-lock in the uppermost reaches of the expansion chamber, the measuring pocket and the vent chamber; and the liquid solution 110 within portion 81 of the inverted J-shaped syphon tube is isolated by means of an air-lock in the uppermost reaches of portions 81 and 82 of the inverted J-shaped syphon tube 89.

Thus a dispenser of the present invention provides complete isolation of the liquid solution within the reservoir and the dispenser during quiescent periods intermediate flush cycles of the toilet. This feature permits co-dispensing of chemical solutions which, due to their reactive nature with one another, may not be utilized in dispensers which fail to isolate them from the toilet tank water during quiescent periods intermediate flush cycles.

Figure 6:
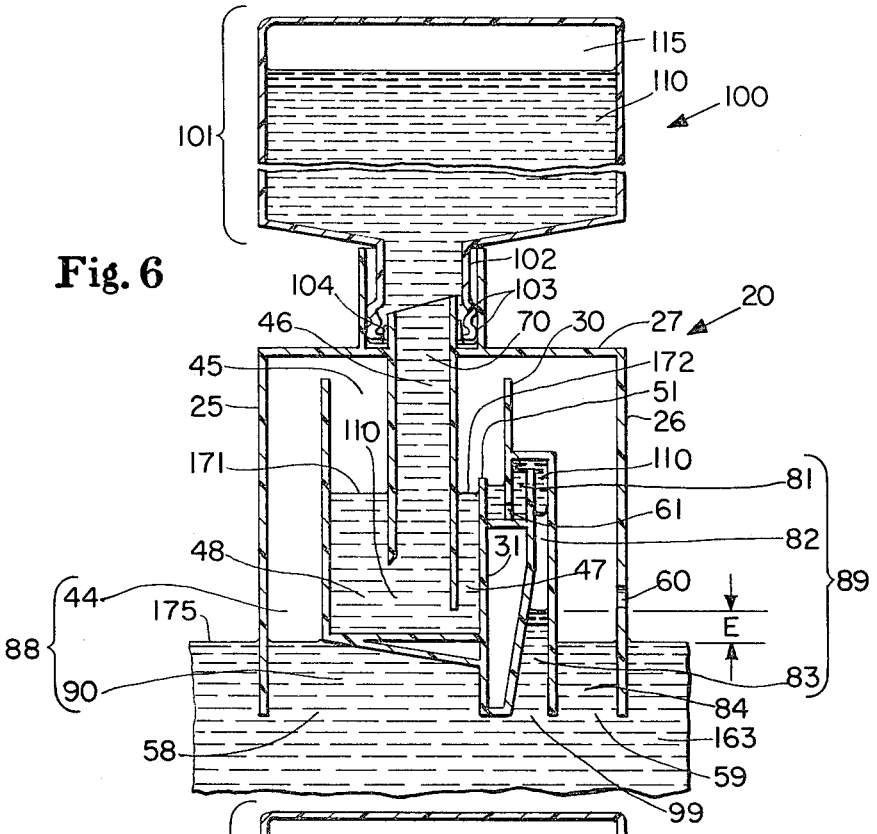

FIG. 6 depicts the condition prevailing when the toilet is flushed and the level 175 of the tank water 163 begins to fall, uncovering air vent 60 in dispenser sidewall 26. Uncovering air vent 60 in sidewall 26 exposes the uppermost reaches of expansion chamber 47, measuring pocket 80 and vent chamber 84 to the atmosphere. As the level 175 of tank water 163 begins to fall, a syphoning action is initiated in the uppermost reaches of the inverted J-shaped syphon tube 89. The suction driving head is represented by the distance "E" illustrated in FIG. 6, i.e., the difference between the level 175 of the water in the toilet tank and the level of the water within the syphon tube. This causes a transfer of liquid solution 110 from the measuring pocket 80 into the uppermost reaches of the inverted J-shaped syphon tube 89, as generally illustrated in FIG. 6. This syphoning action continues until such time as the level of liquid solution in the measuring pocket 80 reaches the uppermost edge of orifice 61. At this point, the level 175 of toilet tank water 163 is generally below the bottom of the dispenser 20, and the liquid solution 110 withdrawn from the measuring cavity 80 is rapidly discharged from inlet/discharge port 99 located at the lowermost end of the syphon tube into the toilet tank water, as generally illustrated in FIG. 7.

Following discharge of the liquid solution 110, the dispenser 20 returns to essentially the same condition illustrated in FIG. 3, with the exception that a small portion of liquid solution 110 remains within the measuring cavity 80 and portion 81 of the inverted J-shaped syphon tube 89. The level of this remaining liquid solution is generally determined by the uppermost edge of orifice 61 in vertical partition segment 30. Because the interior portions of the dispenser 20 are at this point vented to atmosphere and the vacuum within head space 115 of reservoir 100 has been partially vitiated by the air pumping cycle referred to earlier herein, additional liquid solution 110 is fed from the reservoir into the liquid collector 48 of the dispenser until a partial vacuum in the head space of the reservoir again causes the flow to cease. At this point in time, the level 171 of liquid 110 within passageway 45 is equal to the level 172 of liquid 110 in expansion chamber 47.

The dispenser 20 is at this point ready to begin the air pumping cycle anew, and will continue to function in essentially the same manner until such time as the reservoir 100 has discharged all of the liquid solution 110 contained therewithin.

Figure 7:
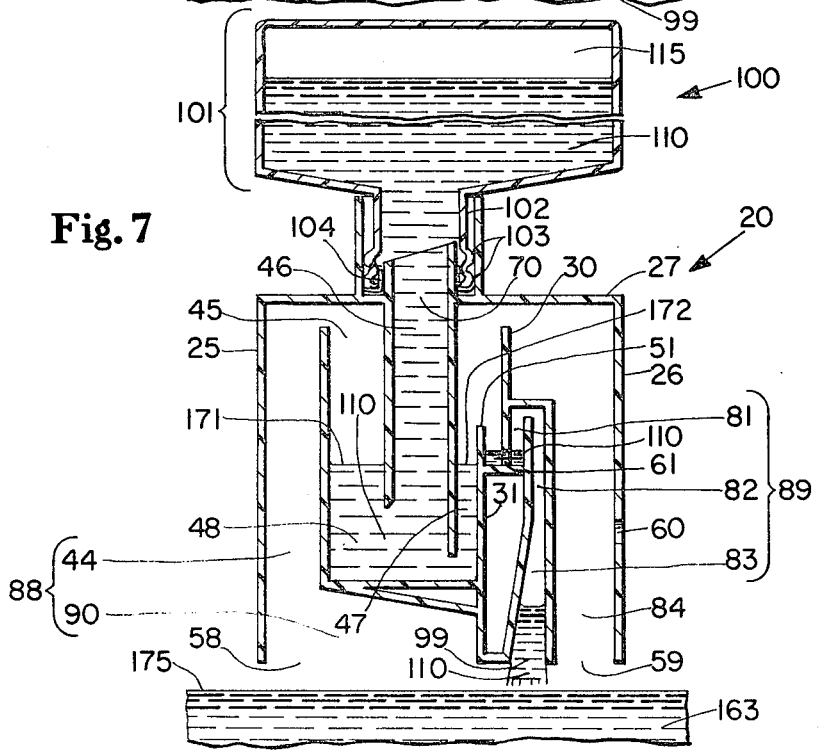

It should be noted from FIGS. 6 and 7 that the dose-volume of liquid solution 110 dispensed during each flush cycle is essentially constant and is substantially equal to the volume of liquid solution within measuring pocket 80 and syphon tube portion 81 intermediate uppermost edge 51 of partition segment 31 and the uppermost edge of orifice 61 in vertical partition segment 30. In this regard it should be noted that the exact level of any liquid solution 110 contained within portion 81 of the syphon tube 89 may, depending upon dispenser geometry, be lower than that in measuring pocket 80. This is due to such factors as pressure of the air-lock within the upper reaches of inverted J-shaped syphon tube 89, surface tension of the liquid solution 110, etc. Nevertheless, the level of any solution 110 contained within portion 81 of the syphon tube 89 will be substantially constant for successive flush cycles of the toilet, thereby ensuring constant volume dispensing. As should also be apparent from the foregoing description, a dispenser 20 of the present invention will function with equal effectiveness to dispense a predetermined dose-volume of liquid solution with each flush cycle regardless of how deep it is immersed into the water contained in the toilet tank, provided only that the depth of immersion is sufficient to fill measuring pocket 80 during the air pumping cycle.

Finally, it should be noted that passive dispensers of the present invention will function with great reliability, since there are no moving parts to jam or malfunction due to buildup of foreign material, breakage or the like.

As has been pointed out earlier herein, dispenser embodiments of the present invention may be constructed with an integral liquid solution reservoir or with a disposable type reservoir as shown generally in FIGS. 2–7. As should also be clear from the foregoing description, the amount of liquid solution dispensed on each flush cycle can be tailored to meet any desired objective by sizing the measuring pocket and syphon tube appropriately. Furthermore, the various functional portions of the dispenser may be sized relative to one another in nearly any fashion desired, it being critical only that the air pump be of sufficient volume to ensure that the measuring pocket is filled on each pumping cycle.

Dispenser embodiments of the present invention may be constructed in any of several known means. For example, the dispenser 20 could be fabricated from 1.6 millimeter thick rigid Plexiglas (Trademark of Rohm & Haas Company) or such. Alternatively, a dispenser having the desired passageways could be vacuum thermoformed of a material such as polyvinylchloride having an initial thickness of about 0.020 inches. The desired cavities could be formed in a single sheet and a finished dispenser thereafter created by securing the formed sheet to a second planar sheet of suitable material by means of heat sealing, adhesives, etc., to form the desired internal configuration. Furthermore, it will be appreciated by those skilled in the art that the internal configuration of the dispenser may be rearranged as desired without altering the operation of the dispenser, e.g., air vent 60 could be located on the front wall or the back wall of the dispenser with equal facility.

In the particularly preferred dispenser embodiment 20 illustrated in FIGS. 1–7, the inverted J-shaped syphon tube 89 is flared near its lowermost end so that its cross-sectional area increases along its length, i.e., along portion 83. The increased cross-sectional area in the lowermost portion of the tube maximizes the acceleration and velocity of the trapped air and the liquid solution 110 in the uppermost portions of the syphon tube which are of smaller, substantially constant cross-section. This in turn tends to minimize residual liquid solution clinging to the interior surfaces of the syphon tube after the discharge cycle illustrated in FIGS. 6 and 7 has occurred.

The vertical location of the air vent 60 in sidewall 26 of the dispenser 20 controls the height to which liquids to be dispensed will rise within the expansion chamber. The higher the air vent is placed in the dispenser, the higher will be the liquid level in the expansion chamber. Conversely, the lower the placement of the air vent, the lower will be the level of liquid in the expansion chamber during the pumping cycle. In this regard it is noteworthy that regardless of how high the liquid solution 110 initially rises in the expansion chamber, only liquid retained within the measuring pocket 80 and portion 81 of the syphon tube 89 is ultimately dispensed, thereby ensuring constant volume discharge with each flush cycle. This is due to the fact that the level 172 of liquid solution 110 in the expansion chamber 47 falls below edge 51 of partition segment 31 prior to initiating of the syphoning action. It is therefore critical that the air vent be so located as to ensure that the measuring pocket is filled during each pumping cycle, i.e., as the water level 175 rises to its maximum elevation in the toilet tank, yet not so high as to eliminate the air-lock formed in the uppermost reaches of vent chamber 84 during the pumping cycle.

Advantages provided by dispenser embodiments of the present invention include: (1) a total absence of moving parts; (2) a constant volume of liquid solution is dispensed during each flush cycle; (3) the dispensing action is in response to the water level dropping during the flush cycle, thereby ensuring that the liquid solution dispensed will reach the toilet bowl rather than remain in the toilet tank; (4) the liquid solution within the dispenser is completely isolated from the tank water prior to dispensing; and (5) once the dispenser has been submerged to a depth sufficient to fill its measuring pocket during the pumping cycle, it will operate to dispense the same volume of liquid solution with each flush cycle regardless of how much deeper the unit is submerged.

As will be appreciated by those skilled in the art, dispensing the liquid solution near the end of each flush cycle, i.e., as the tank water level is falling, results in a higher concentration of the liquid solution in the toilet bowl after the flush cycle has been completed than if the material were dispensed during the early portion of the flush cycle. This is so because of the inherent operation of a flushing toilet. Generally all the water from the toilet tank goes through the toilet bowl. However, the initial portions of water are used to initiate a syphon action which carries away the waste material, while the latter portions are used to refill the toilet bowl. By dispensing the product solution into the latter discharged portions of the tank water a higher solution concentration in the toilet bowl is provided intermediate flush cycles. If the product solution were dispensed into the initially discharged portions of the toilet tank water, a large portion of the solution would be carried away with the waste material so that the concentration of solution remaining in the toilet bowl would be greatly reduced.

Figure 8:
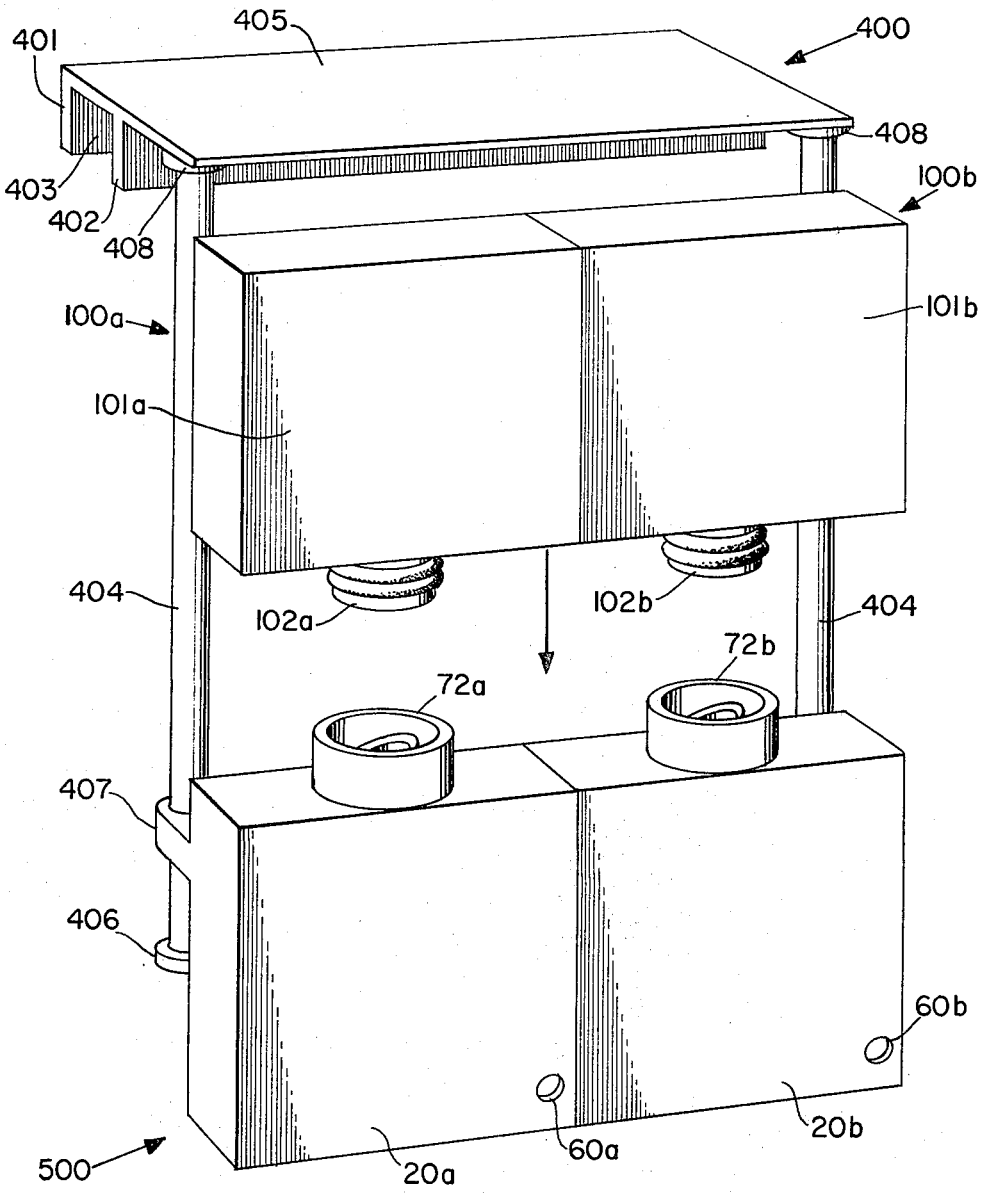
FIG. 8 is a simplified perspective view of a dual dispenser embodiment of the present invention wherein a pair of dispenser units of the type generally illustrated in FIG. 1 are secured to one another and suspended from a common, vertically adjustable mounting bracket.

Isolation of the liquid product solution from the surrounding toilet tank water, as provided by dispenser embodiments of the present invention, makes it feasible to co-dispense cleansing and/or disinfecting solutions with one another despite their incompatibility if exposed to one another during quiescent periods intermediate flush cycles. One such co-dispensing apparatus 500 wherein a pair of dispenser embodiments **20*a* and 20*b* are secured to one another in adjacent relation is illustrated in FIG. 8. The dispenser embodiments 20*a* and 20*b* are each generally similar to dispenser embodiment 20 illustrated in FIGS. 1–7, with the exception that air vent 60 has been replaced by air vents 60*a* and 60*b* located in the front walls of the latter dispenser embodiments. Product reservoirs 100*a* and 100*b* having body portions 101*a* and 101*b* and shoulder portions 102*a* and 102*b*, respectively, are substantially similar to product solution reservoir 100 illustrated in FIGS. 2–7**.

Also shown in FIG. 8 is an adjustable mounting bracket 400 suitable for suspending the co-dispensing apparatus 500 from the lip (not shown) of a toilet tank. The bracket 400 is comprised of a horizontal section 405 having two vertical intersecting segments 401 and 402 located adjacent one edge thereof. The groove 403 thus formed serves as a restraining clamp to grip the lip of the toilet tank. Opposite the groove a pair of collars 408 are secured to the mounting plate 405, said collars being designed to removably receive a pair of cylindrical support members 404 which may be joined to the collars by any suitable means such as screw threads, etc. The vertical cylindrical support members 404 pass through a pair of collars 407 secured to the back wall of the co-dispensing unit 500. The lowermost ends of the cylindrical support members 404 are provided with restraining means 406 to prevent the co-dispensing unit 500 from falling into the toilet tank. The cylindrical support members 404 engage the collars 407 with a degree of friction sufficient to hold the co-dispensing unit 500 at any desired vertical position regardless of the buoyant forces exerted on the co-dispensing unit by the water in the toilet tank.

While particular embodiments of the present invention have been illustrated and described, it will be obvious to those skilled in the art that various changes and modifications can be made without departing from the spirit and scope of the invention, and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dose-volume liquid solution dispenser which isolates said liquid solution from a body of liquid in which said dispenser is immersed by means of air-locks, said dispenser comprising a reservoir for containing a quantity of said liquid solution, said reservoir having an outlet in exclusive fluid communication with a liquid solution collector located at a lower elevation than said outlet of said reservoir, a measuring pocket of predetermined volume, said measuring pocket having an inlet in fluid communication with said collector, said inlet being at a higher elevation than said collector, means for filling said measuring pocket with said liquid solution from said collector in response to the level of a body of liquid being raised from a first elevation to a second elevation, means for introducing a volume of air substantially equal to the dose-volume of liquid solution to be dispensed into the upper reaches of said reservoir in response to the level of said body of liquid being raised from a first elevation to a second elevation, and means for discharging said liquid solution contained within said measuring pocket from said dispenser in response to the level of said body of liquid being lowered to said first elevation from said second elevation.

2. The dispenser of claim 1, wherein said means for filling said measuring pocket with said liquid solution and said means for introducing a volume of air substantially equal to the dose-volume of liquid solution to be dispensed into the upper reaches of said reservoir comprise an air pump, an expansion chamber and an air vent in said dispenser, said air pump having an open lowermost end to permit fluid communication with said body of liquid and an uppermost end in fluid communication with said collector, said collector also being in fluid communication with the lowermost end of said expansion chamber, said expansion chamber having its uppermost end in fluid communication with said inlet to said measuring pocket and said air vent, said air vent being so vertically positioned on said dispenser as to permit said air pump to force liquid solution from said collector into said expansion chamber to a height sufficient to fill said measuring pocket through said inlet in response to the level of said body of liquid being raised from said first elevation to said second elevation, said air vent further preventing said solution in said dispenser from contacting said body of liquid in which said dispenser is immersed when said body of liquid is raised to said second elevation.

3. The dispenser of claim 2, wherein said means for discharging said liquid solution contained within said measuring pocket comprises a syphon tube having its uppermost end in fluid communication with the lowermost reaches of said measuring pocket and an open lowermost end to permit fluid communication with said body of liquid.

4. The dispenser of claim 3, wherein said syphon tube exhibits an inverted J-shape.

5. The dispenser of claim 4 or 5 wherein said syphon tube exhibits an increasing cross-sectional area along its length in the direction of its lowermost end.

6. The dispenser of claim 1 or 2 wherein said liquid solution reservoir is permanently secured to said dispenser.

7. The dispenser of claim 1 or 2, wherein said liquid solution reservoir is removably secured to said dispenser.

* * * * *

UNITED STATES PATENT AND TRADEMARK OFFICE

CERTIFICATE OF CORRECTION

PATENT NO. : 4,251,012

DATED : February 17, 1981

INVENTOR(S) : WILLIAM A. OWENS and ALVESTER WILLIAMS, JR.

It is certified that error appears in the above-identified patent and that said Letters Patent are hereby corrected as shown below:

Column 12, line 19, Claim 5, delete -- or 5 --.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*